US010495328B2

(12) United States Patent
Yamamoto et al.

(10) Patent No.: US 10,495,328 B2
(45) Date of Patent: Dec. 3, 2019

(54) OUTDOOR UNIT OF AIR CONDITIONER AND REFRIGERATION CYCLE DEVICE

(71) Applicant: Mitsubishi Electric Corporation, Tokyo (JP)

(72) Inventors: Katsuyuki Yamamoto, Tokyo (JP); Seiji Nakashima, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/749,826

(22) PCT Filed: Nov. 2, 2015

(86) PCT No.: PCT/JP2015/080937
§ 371 (c)(1),
(2) Date: Feb. 2, 2018

(87) PCT Pub. No.: WO2017/077576
PCT Pub. Date: May 11, 2017

(65) Prior Publication Data

US 2018/0224135 A1 Aug. 9, 2018

(51) Int. Cl.
*F24F 1/38* (2011.01)
*F24F 1/40* (2011.01)

(52) U.S. Cl.
CPC . *F24F 1/38* (2013.01); *F24F 1/40* (2013.01)

(58) Field of Classification Search
CPC .... F24F 1/38; F24F 1/40; F24F 1/0012; F24F 1/022; F24F 1/00; F24F 1/0011;
(Continued)

(56) References Cited

U.S. PATENT DOCUMENTS

2011/0000653 A1* 1/2011 Nakagawa ..... F24F 1/38 165/121
2011/0192186 A1* 8/2011 Kato ..... F04D 29/162 62/324.3
(Continued)

FOREIGN PATENT DOCUMENTS

JP H04-251138 A 9/1992
JP H05-071768 A 3/1993
(Continued)

OTHER PUBLICATIONS

International Search Report of the International Searching Authority dated Feb. 2, 2016 for the corresponding international application No. PCT/JP2015/080937 (and English translation).
(Continued)

*Primary Examiner* — Emmanuel E Duke
(74) *Attorney, Agent, or Firm* — Posz Law Group, PLC

(57) ABSTRACT

A casing has a wall portion surrounding an impeller, as seen in an axial direction of a rotating shaft. The wall portion of the casing has a portion, and a portion located further away from a center of rotation of the rotating shaft than the portion, as seen in the axial direction. A curved portion has a curved surface portion located on a line connecting the center of rotation and the portion, and a curved surface portion located on a line connecting the center of rotation and the portion, as seen in the axial direction. A radius of curvature of the curved surface portion is greater than a radius of curvature of the curved surface portion.

10 Claims, 12 Drawing Sheets

(58) Field of Classification Search
CPC ..... F24F 1/0007; F04D 29/54; F04D 29/38; F04D 29/44; F04D 29/522; F04D 29/281; F04D 29/32; F24D 29/4213
See application file for complete search history.

(56) References Cited

U.S. PATENT DOCUMENTS

| | | | | |
|---|---|---|---|---|
| 2013/0125579 | A1* | 5/2013 | Okazawa | F24F 1/38 62/507 |
| 2014/0299298 | A1* | 10/2014 | Kono | F24F 1/40 165/121 |

FOREIGN PATENT DOCUMENTS

| | | | |
|---|---|---|---|
| JP | H10-068537 | A | 3/1998 |
| JP | H11-337126 | A | 12/1999 |
| JP | 2013-096622 | A | 5/2013 |
| JP | 2015-129504 | A | 7/2015 |

OTHER PUBLICATIONS

Office Action dated Nov. 20, 2018 issued in corresponding JP patent application No. 2017-548541 (and English translation).
Office Action dated May 7, 2019 issued in corresponding JP patent application No. 2017-548541 (and English translation).

* cited by examiner (A)

(B)

OUTDOOR UNIT OF AIR CONDITIONER AND REFRIGERATION CYCLE DEVICE

CROSS REFERENCE TO RELATED APPLICATION

This application is a U.S. national stage application of International Application No. PCT/JP2015/080937, filed on Nov. 2, 2015, the contents of which are incorporated herein by reference.

TECHNICAL FIELD

The present invention relates to an outdoor unit for use in an air conditioner and a refrigeration cycle device.

BACKGROUND

An outdoor unit of an air conditioner is sometimes installed in a narrow space due to architectural circumstances and the like. In this case, an adequate space is not available between an outlet side of the outdoor unit and a wall surface of a building. Thus, there is no adequate air outlet passage on the outlet side of the outdoor unit, causing an increase in draft resistance. Accordingly, a radial velocity component of an outlet flow from the outdoor unit increases, while its axial velocity component decreases.

The configuration of an outdoor unit installed in a narrow space as described above is disclosed, for example, in Japanese Patent Laying-Open No. 4-251138 (see PTD 1). In PTD 1, a ring is mounted on an outlet port of an orifice. This ring has an inner diameter dimension slightly greater than an outer diameter dimension of an impeller, and has the shape of a drop of water in cross section.

According to PTD 1, an air flow blown obliquely from the impeller is caused by the ring to be blown along an inner circumferential surface of the ring and a wall surface of the outlet port of the orifice, thereby not causing degradation in performance of a blower and an increase in noise.

PATENT LITERATURE

PTD 1: Japanese Patent Laying-Open No. 4-251138

However, PTD 1 does not consider the fact that a radial velocity component of the outlet flow varies in a circumferential direction depending on the conditions on the intake side. Depending on the conditions on the intake side, the air flow blown from the impeller does not flow sufficiently along the wall surface of the outlet port of the orifice, causing an increase in draft resistance and an increase in noise.

SUMMARY

The present invention was made in view of the aforementioned problems, and has an object to provide an outdoor unit of an air conditioner having low draft resistance and low noise.

One outdoor unit of an air conditioner of the present invention includes a casing, an impeller, and a bell mouth. The casing has an air outlet port. The impeller is disposed in the casing and rotatable about a rotating shaft. The bell mouth surrounds an outer periphery of the impeller. The bell mouth has a straight pipe portion and a curved portion. The straight pipe portion surrounds the outer periphery of the impeller. The curved portion is located between the straight pipe portion and the air outlet port, and increases in diameter from the straight pipe portion toward the air outlet port. The casing has a wall portion surrounding the impeller, as seen in an axial direction of the rotating shaft. The wall portion has a first portion, and a second portion located further away from a center of rotation of the rotating shaft than the first portion, as seen in the axial direction. The curved portion has a first curved surface portion located on a line connecting the center of rotation and the first portion, and a second curved surface portion located on a line connecting the center of rotation and the second portion, as seen in the axial direction. A radius of curvature of the second curved surface portion is greater than a radius of curvature of the first curved surface portion.

Another outdoor unit of an air conditioner of the present invention includes a casing, an impeller, and a bell mouth. The casing has an air outlet port. The impeller is disposed in the casing and rotatable about a rotating shaft. The bell mouth surrounds an outer periphery of the impeller. The bell mouth has a straight pipe portion and a flared portion. The straight pipe portion surrounds the outer periphery of the impeller. The flared portion is located between the straight pipe portion and the air outlet port, and increases in diameter from the impeller toward the air outlet port. The casing has a wall portion surrounding the impeller, as seen in an axial direction of the rotating shaft. The wall portion has a first portion, and a second portion located further away from a center of rotation of the rotating shaft than the first portion, as seen in the axial direction. The flared portion has a first extending portion located on a line connecting the center of rotation and the first portion, and a second extending portion located on a line connecting the center of rotation and the second portion, as seen in the axial direction. The first extending portion has a first dimension along the axial direction. The second extending portion has a second dimension along the axial direction. The second dimension is greater than the first dimension.

According to the one outdoor unit of an air conditioner of the present invention, the radius of curvature of the curved portion of the bell mouth is set to be greater in the portion in which the length from the center of rotation of the impeller to the wall surface of the casing is greater than in the portion in which the aforementioned length is smaller. Thus, an air flow can be flown along the curved portion in the portion of the greater length. Accordingly, draft resistance and noise can be reduced.

According to the another outdoor unit of an air conditioner of the present invention, the axial dimension of the flared portion is set to be greater in the portion in which the length from the center of rotation of the impeller to the wall surface of the casing is greater than in the portion in which the aforementioned length is smaller. Thus, an air flow can be flown along the curved portion in the portion of the greater length. Accordingly, draft resistance and noise can be reduced.

DETAILED DESCRIPTION

Figure 1:
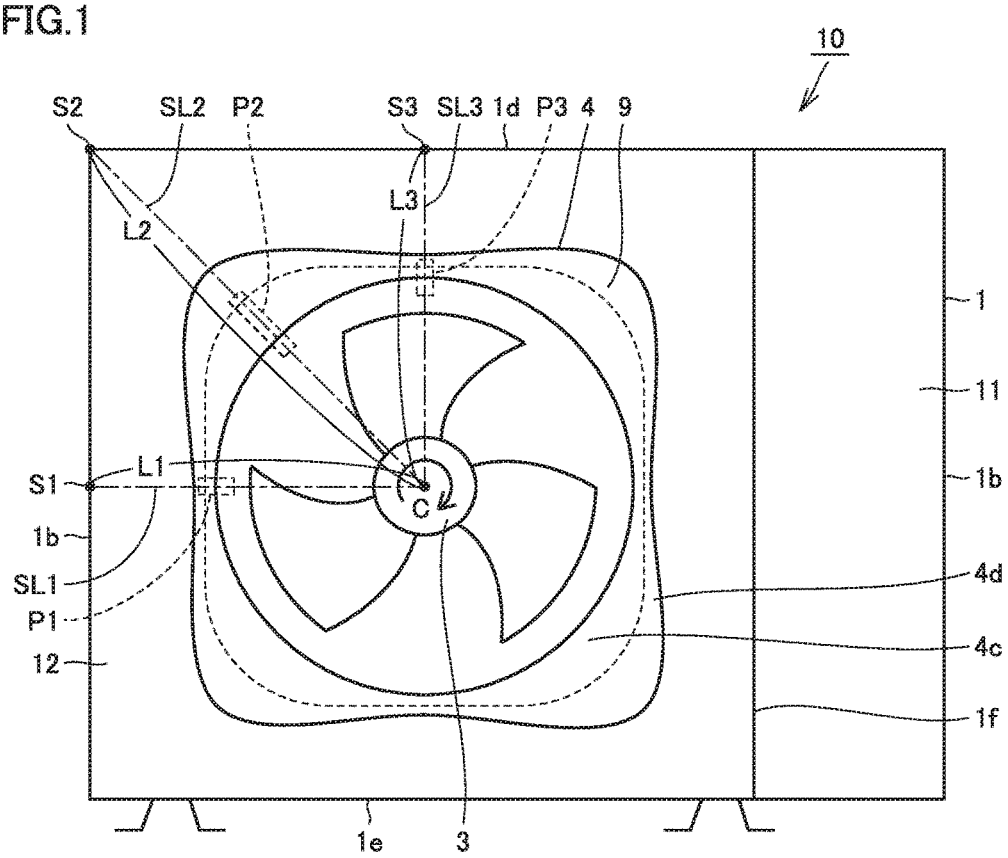
FIG. 1 is a front view schematically showing a configuration of an outdoor unit of an air conditioner according to a first embodiment of the present invention.

Embodiments of the present invention will now be described with reference to the drawings.

It should be noted that the same or corresponding elements are designated by the same reference characters in FIGS. 1 to 12, which applies throughout the specification.

First Embodiment

Figure 2:
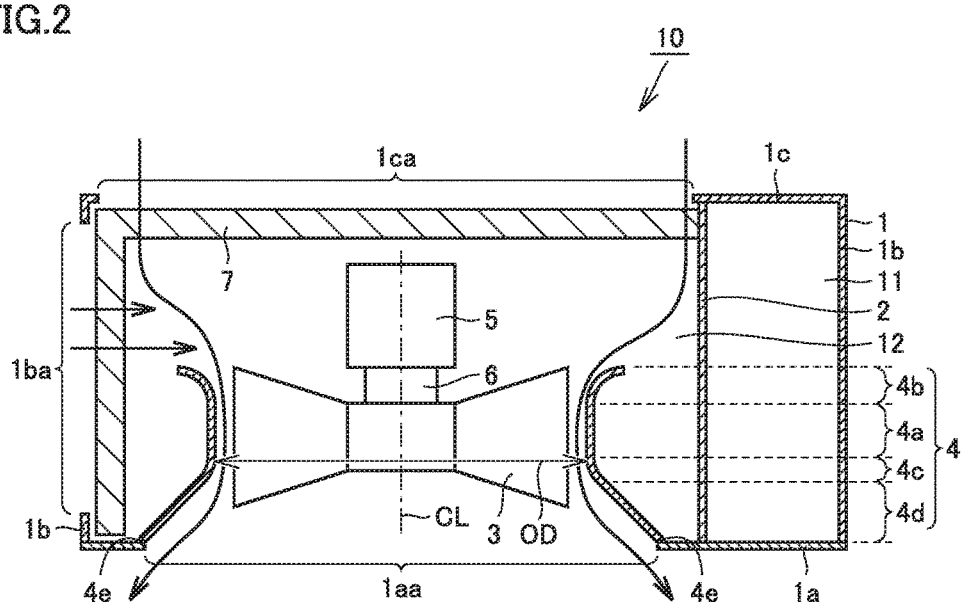
FIG. 2 is a sectional view showing the configuration of the outdoor unit shown in FIG. 1.

As shown in FIGS. 1 and 2, an outdoor unit 10 of an air conditioner according to a first embodiment of the present invention mainly has a casing 1, an impeller 3, a bell mouth 4, a driving source 5, a rotating shaft 6, and an outdoor heat exchanger 7.

Casing 1 has a front panel 1*a*, a pair of right and left side panels 1*b*, a back panel 1*c*, a top panel 1*d*, a bottom panel 1*e*, and a separator 1*f*. These panels 1*a* to 1*e* are assembled into a substantially rectangular parallelepiped shape, whereby casing 1 has a box shape. Separator if is disposed in an internal space of casing 1. This separator 1*f* separates the internal space of casing 1 into a machine room 11 and a blower room 12.

A compressor (not shown) and the like are disposed in machine room 11. Impeller 3, bell mouth 4, driving source 5, rotating shaft 6, outdoor heat exchanger 7 and the like are disposed in blower room 12.

Outdoor heat exchanger 7 has an L-shape, for example, in a plan view of FIG. 2. Outdoor heat exchanger 7 is disposed along side panel 1*b* and back panel 1*c* of casing 1. It should be noted that the plan view means a viewpoint from above along a direction orthogonal to an upper surface of top panel 1*d*.

Casing 1 is provided with air intake ports 1*ba* and 1*ca* on at least two surfaces thereof. Air intake port 1*ba* is provided on side panel 1*b*, and air intake port 1*ca* is provided on back panel 1*c*. Air can be sucked from the outside of casing 1 to the inside of casing 1 through each of air intake ports 1*ba* and 1*ca*. The air that has been sucked into casing 1 through air intake ports 1*ba* and 1*ca* can exchange heat with outdoor heat exchanger 7.

Casing 1 is provided with an air outlet port 1*aa*. This air outlet port 1*aa* is provided on front panel 1*a*. Air can be blown from the inside of casing 1 to the outside of casing 1 through air outlet port 1*aa*. Accordingly, the air that has exchanged heat with outdoor heat exchanger 7 is blown to the outside of casing 1 through air outlet port 1*aa*.

Driving source 5 is a fan motor, for example. Driving source 5 is disposed in front of outdoor heat exchanger 7. Driving source 5 is attached to casing 1 with a driving source support plate (not shown) interposed therebetween.

Impeller 3 is attached to driving source 5 with rotating shaft 6 interposed therebetween. Impeller 3 is disposed in front of driving source 5. Impeller 3 is for generating air circulation for efficient heat exchange in outdoor heat exchanger 7. Impeller 3 can rotate around an axis CL of rotating shaft 6, with a driving force supplied from the driving source. Impeller 3 has the function of rotating to introduce outdoor air into blower room 12 through each of air intake ports 1*ba* and 1*ca*, and then to discharge the air to the outside of casing 1 through air outlet port 1*aa*.

Bell mouth 4 is attached to a backside surface (rear surface) of front panel 1*a*. Bell mouth 4 is disposed to surround an outer periphery of impeller 3. Bell mouth 4 has a straight pipe portion 4*a*, a reduced diameter portion 4*b*, a curved portion 4*c*, and a flared portion 4*d*. Straight pipe portion 4*a*, reduced diameter portion 4*b*, curved portion 4*c* and flared portion 4*d* are integrally formed to constitute a single component.

Straight pipe portion 4*a* surrounds the outer periphery of impeller 3. Straight pipe portion 4*a* has a cylindrical shape, and extends from the front toward the back while maintaining a diameter of the cylinder. Reduced diameter portion 4*b* is connected to a back end of straight pipe portion 4*a*. Reduced diameter portion 4*b* has a tubular shape, and is formed such that an opening diameter of the tubular shape decreases from a back end toward a front end. Reduced diameter portion 4*b* has the smallest opening diameter at a joint with straight pipe portion 4*a*.

Curved portion 4*c* is connected to a front end of straight pipe portion 4*a*. Curved portion 4*c* is located between straight pipe portion 4*a* and air outlet port 1*aa*. Curved portion 4*c* increases in diameter from straight pipe portion 4*a* toward air outlet port 1*aa*. Accordingly, an opening diameter OD of curved portion 4*c* (FIG. 2) increases from straight pipe portion 4*a* toward air outlet port 1*aa*. At least an inner peripheral surface of curved portion 4*c* is formed in a curved manner in a cross section shown in FIG. 2. The cross section shown in FIG. 2 is a cross section along a plane which includes axis CL of rotating shaft 6 and is parallel to axis CL.

Flared portion 4*d* is connected to a front end of curved portion 4*c*. Flared portion 4*d* is located between curved portion 4*c* and air outlet port 1*aa*. Flared portion 4*d* increases in diameter from curved portion 4*c* toward air outlet port 1*aa*. Accordingly, in flared portion 4*d*, the opening diameter of bell mouth 4 increases from curved portion 4*c* toward air outlet port 1*aa*. At least an inner peripheral surface of flared portion 4*d* is formed linearly in the cross section shown in FIG. 2. A front end of flared portion 4*d* (the end portion closer to the front panel) is connected to the backside surface of the front panel.

As shown in FIG. 1, casing 1 has a wall portion surrounding impeller 3, as seen in an axial direction of rotating shaft 6 (a direction of axis CL in FIG. 2). This wall portion surrounding impeller 3 is formed of, for example, side panel 1*b* on the left in the figure, top panel 1*d*, bottom panel 1*e*, and separator 1*f*. Wall portions 1*b*, 1*d*, 1*e* and 1*f* surrounding impeller 3 form a substantially rectangular shape as seen in the axial direction of rotating shaft 6.

As seen in the axial direction of rotating shaft 6, wall portions 1*b*, 1*d*, 1*e* and 1*f* surrounding impeller 3 have portions of different lengths from a center of rotation C of impeller 3 (a point on axis CL in FIG. 2). For example, portions S1, S2 and S3 of wall portions 1*b*, 1*d*, 1*e* and 1*f* surrounding impeller 3 have lengths L1, L2 and L3 from center of rotation C of impeller 3, respectively, which are different from one another.

Specifically, the aforementioned portion S1 is a portion on side panel 1*b*, the aforementioned portion S2 is a portion (corner) where side panel 1*b* and top panel 1*d* intersect each other, and the aforementioned portion S3 is a portion on top panel 1*d*.

As seen in the axial direction of rotating shaft 6, length L2 between the aforementioned S2 and center of rotation C is greater than length L1 between the aforementioned S1 and center of rotation C, and length L3 between the aforementioned S3 and center of rotation C. That is, the aforementioned portion S2 is located further away from center of rotation C than the aforementioned portions S1 and S3.

Curved portion 4*c* has, for example, a curved surface portion (first curved surface portion) P1, a curved surface portion (second curved surface portion) P2, and a curved surface portion (third curved surface portion) P3. As seen in the axial direction of rotating shaft 6 as shown in FIG. 2, curved surface portion P1 is a portion located on a straight line SL1 (first line) connecting center of rotation C and the aforementioned portion S1. As seen in the axial direction of rotating shaft 6, curved surface portion P2 is a portion located on a straight line SL2 (second line) connecting center of rotation C and the aforementioned portion S2. As seen in the axial direction of rotating shaft 6, curved surface portion P3 is a portion located on a straight line SL3 (third line) connecting center of rotation C and the aforementioned portion S3.

Figure 3:
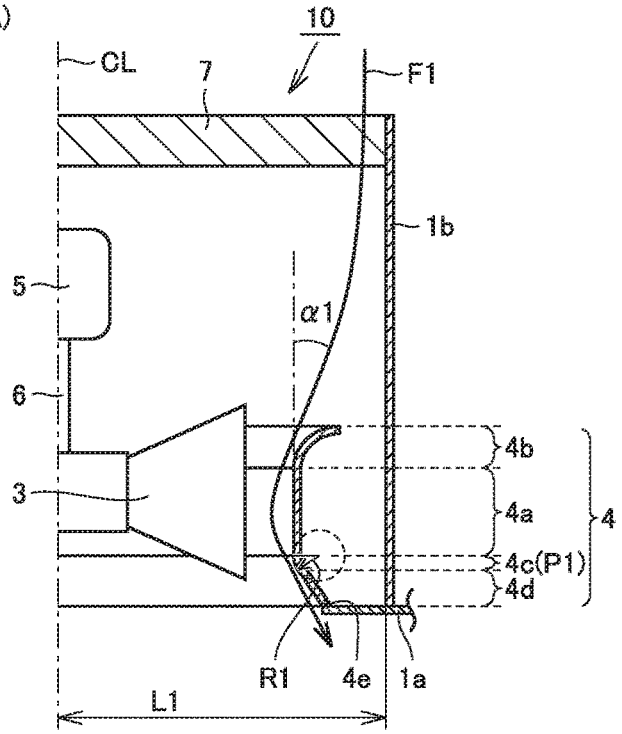
FIG. 3 shows a partial sectional view (A) of a portion in which the length from the center of rotation of an impeller to a wall surface of a casing is L1, and a partial sectional view (B) of a portion in which the aforementioned length is L2, in the outdoor unit shown in FIG. 1.
Figure 3:
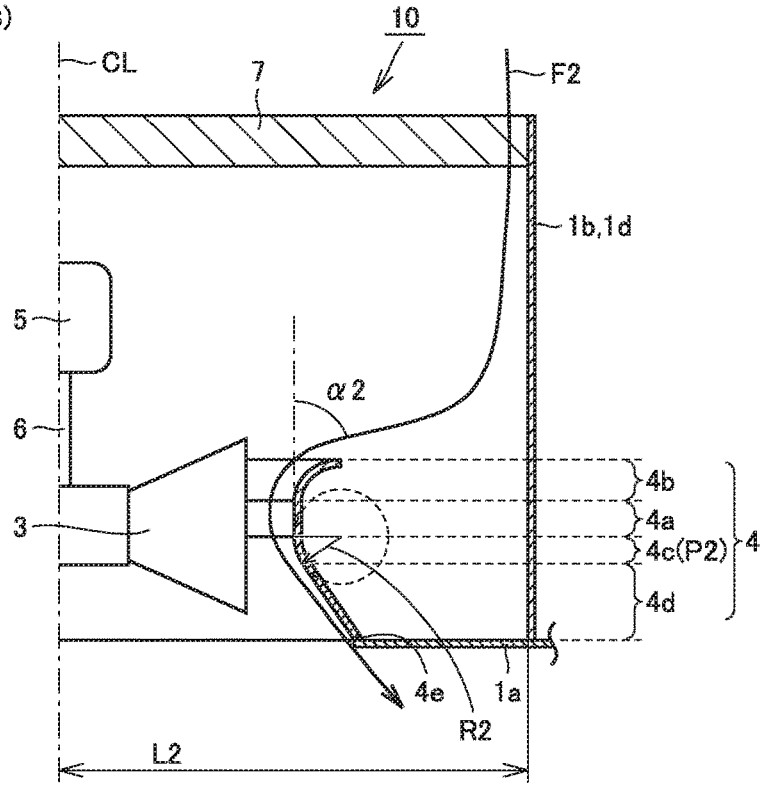

A cross section of outdoor unit 10 along the aforementioned straight line SL1 is shown in FIG. 3 (A), and a cross section of outdoor unit 10 along the aforementioned straight line SL2 is shown in FIG. 3 (B).

A radius of curvature R2 of curved surface portion P2 shown in FIG. 3 (B) is set to be greater than a radius of curvature R1 of an inner peripheral surface of curved surface portion P1 shown in FIG. 3 (A). Radius of curvature R2 of an inner peripheral surface of curved surface portion P2 is set to be greater than a radius of curvature of curved surface portion P3 in FIG. 1.

As described above, in bell mouth 4 of the present embodiment, as seen in the axial direction of rotating shaft 6 as shown in FIG. 2, the radius of curvature of a portion (for example, curved surface portion P2) of curved portion 4*c* in which the length between wall portions 1*b*, 1*d*, 1*e* and 1*f* surrounding impeller 3 and center of rotation C is greater is set to be greater than the radius of curvature of a portion (for example, curved surface portions P1 and P3) of curved portion 4*c* in which the aforementioned length is smaller.

It should be noted that the radius of curvature of curved portion 4*c* may continuously vary in a circumferential direction around center of rotation C, as shown in FIG. 1.

Figure 4:
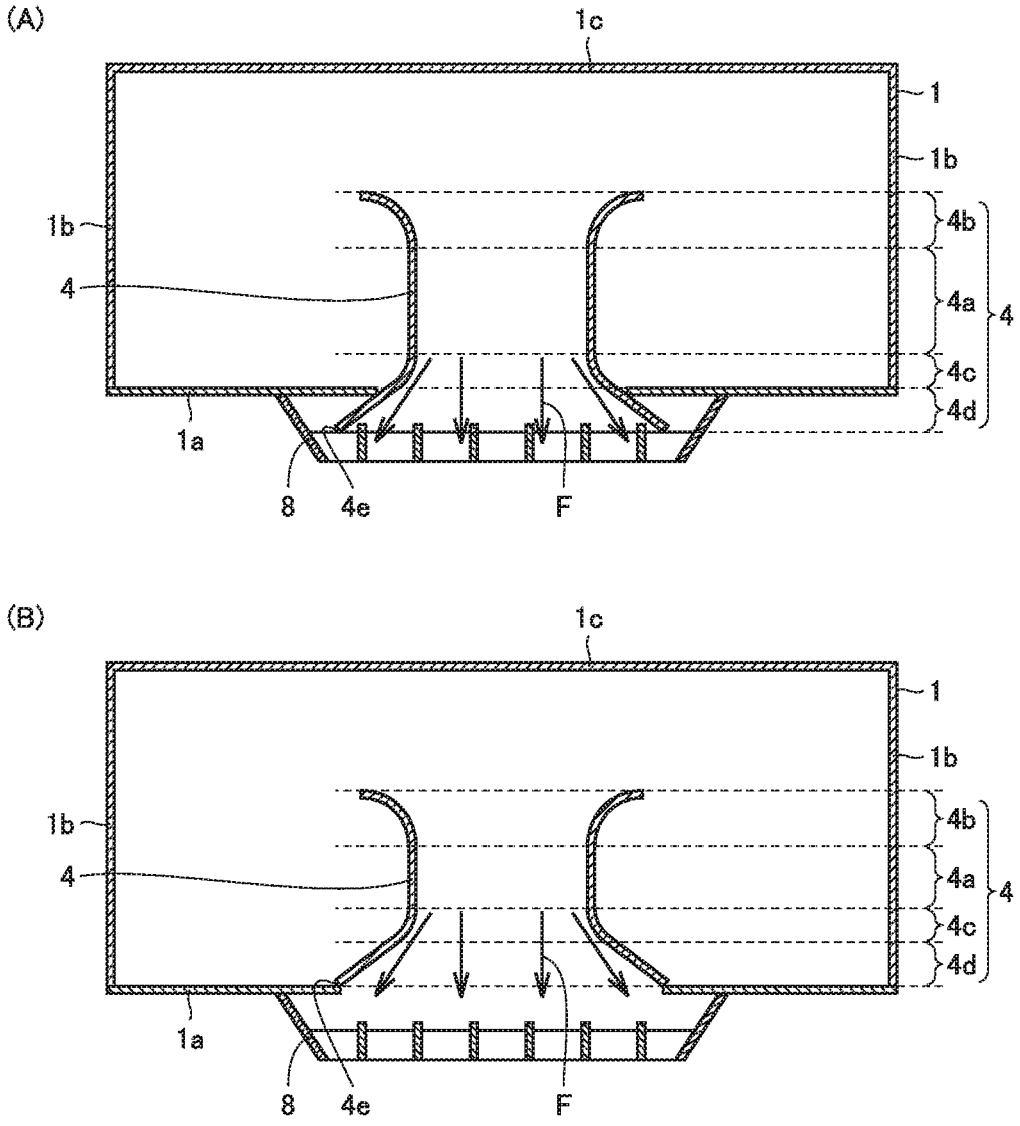
FIG. 4 shows a sectional view (A) showing a configuration in which an outlet portion of a bell mouth protrudes from a front panel, and a sectional view (B) showing a configuration in which the outlet portion of the bell mouth does not protrude from the front panel.

A front end 4*e* of bell mouth 4 may protrude forward past front panel 1*a*, as long as it is located behind an outlet grille 8, as shown in FIG. 4 (A). However, it is preferable that front end 4*e* of bell mouth 4 not protrude forward past front panel 1*a*, as shown in FIG. 4 (B).

Next, the function and effect of the present embodiment will be described.

As shown in FIG. 2, impeller 3 rotates to generate an intake flow from the outdoor heat exchanger 7 side. Since the effect of a moving blade is imparted to this intake flow, the intake flow is blown with an increase in radial velocity component. Thus, the flow having an increased radial velocity component can be flown along bell mouth 4 by adjusting the magnitude of the radius of curvature of curved portion 4*c* of bell mouth 4. Accordingly, flow separation in bell mouth 4 can be suppressed to reduce draft resistance.

In a conventional bell mouth, however, the radius of curvature of curved portion 4*c* is constant in the circumferential direction around center of rotation C. Thus, a conventional bell mouth does not take into account the fact that a flow path of an outlet flow varies depending on the intake conditions at each position in the circumferential direction of the bell mouth. Accordingly, an air flow cannot be flown sufficiently along curved portion 4*c* and flared portion 4*d* of bell mouth 4.

As shown in FIG. 3 (A), in the cross section of the portion of length L1, an angle $\alpha 1$ formed by an intake flow F1 and straight pipe portion 4*a* of bell mouth 4 is smaller. Accordingly, even when radius of curvature R1 of curved portion 4*c* of bell mouth 4 is relatively small, the flow can be flown along that smaller radius of curvature R1.

However, as shown in FIG. 3 (B), in the cross section of the portion of length L2, an angle $\alpha 2$ formed by an intake flow F2 and straight pipe portion 4*a* of bell mouth 4 is greater. Thus, inertia acts on intake flow F2 toward center of rotation C of impeller 3. Accordingly, when the radius of curvature of curved portion 4*c* of bell mouth 4 is constant in whole, the flow cannot be sufficiently induced toward the radially outer side. Thus, flow separation occurs at curved portion 4*c* and flared portion 4*d* of bell mouth 4.

In contrast, in the present embodiment, as shown in FIG. 3 (A) and FIG. 3 (B), radius of curvature R2 of curved surface portion P2 of curved portion 4*c* in which the length between the wall portion of casing 1 and center of rotation C is greater is set to be greater than radius of curvature R1 of curved surface portion P1 of curved portion 4*c* in which the aforementioned length is smaller, as seen in the axial direction of rotating shaft 6.

In this manner, in the present embodiment, radius of curvature R2 of curved portion 4*c* is set to be greater in the cross section of greater length L2 from center of rotation C, thereby allowing the flow to be induced significantly toward the radially outer side. Accordingly, the flow can be flown along curved portion 4*c* and flared portion 4*d*, thereby suppressing the separation and reducing the draft resistance.

The suppression of separation can in turn suppress the generation of a turbulent flow and reduce turbulent sound, thereby reducing the noise.

When front end 4*e* of bell mouth 4 is not connected to front panel 1*a* of casing 1 but protrudes forward past front panel 1*a* as shown in FIG. 4 (A), the effects similar to the above can be obtained by increasing radius of curvature R2 of curved portion 4*c* in the cross section of greater length L2 from center of rotation C.

Here, a wind speed of the flow in bell mouth 4 decreases, as the opening diameter of bell mouth 4 increases along the flow, due to diffusion of the flow. However, when front end 4*e* of bell mouth 4 protrudes forward past front panel 1*a* as shown in FIG. 4 (A), the space between outlet grille 8 located downstream and bell mouth 4 decreases. Thus, the flow is not sufficiently decelerated in the bell mouth, and collides with outlet grille 8 while maintaining a high wind speed, resulting in increased noise.

When front end 4*e* of bell mouth 4 does not protrude forward past front panel 1*a* as shown in FIG. 4 (B), on the other hand, the space between outlet grille 8 and bell mouth 4 increases. Thus, the flow blown from bell mouth 4 is sufficiently decelerated between outlet grille 8 and bell mouth 4. Accordingly, the outlet flow collides with outlet grille 8 at a sufficiently reduced speed, thereby suppressing the noise.

Figure 5:
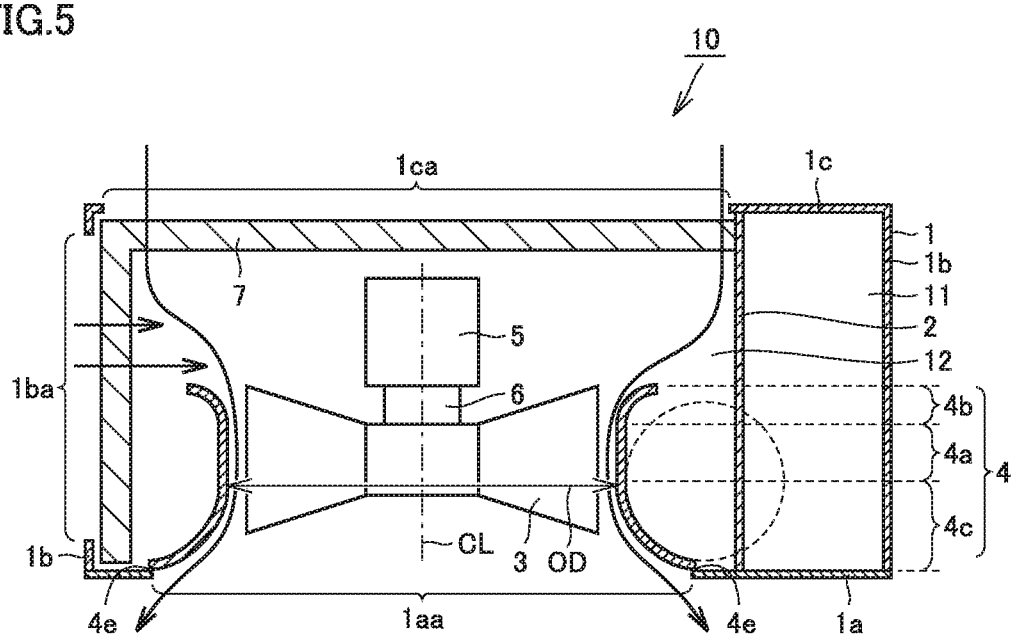
FIG. 5 is a sectional view schematically showing another configuration of the outdoor unit of an air conditioner according to the first embodiment of the present invention.

While the present embodiment has described a configuration in which curved portion 4*c* and flared portion 4*d* are provided at the front end side of straight pipe portion 4*a* of bell mouth 4, flared portion 4*d* does not need to be provided. In this case, as shown in FIG. 5, curved portion 4*c* is located entirely from the front end of straight pipe portion 4*a* to front end 4*e* of bell mouth 4.

An axial dimension of straight pipe portion 4*a* in the cross section of the portion of greater length L2 from center of rotation C to the wall portion of casing 1 as shown in FIG. 3 (B) may be smaller than an axial dimension of straight pipe portion 4*a* in the cross section of smaller length L1 from center of rotation C as shown in FIG. 3 (A). An axial dimension of flared portion 4*d* in the cross section of greater length L2 from center of rotation C as shown in FIG. 3 (B) may be greater than an axial dimension of flared portion 4*d* in the cross section of smaller length L1 from center of rotation C as shown in FIG. 3 (A). Increasing the axial dimension of flared portion 4*d* is effective because the flow can thereby be further induced toward the radially outer side.

Second Embodiment

A configuration of the present embodiment is different from the configuration of the first embodiment shown in FIGS. 1 to 5 in terms of the configuration of curved portion 4*c* of bell mouth 4.

In bell mouth 4 of the present embodiment, the radius of curvature of at least one of a curved surface portion having a greater radius of curvature and a curved surface portion having a smaller radius of curvature is maintained in the circumferential direction around center of rotation C.

Figure 6:
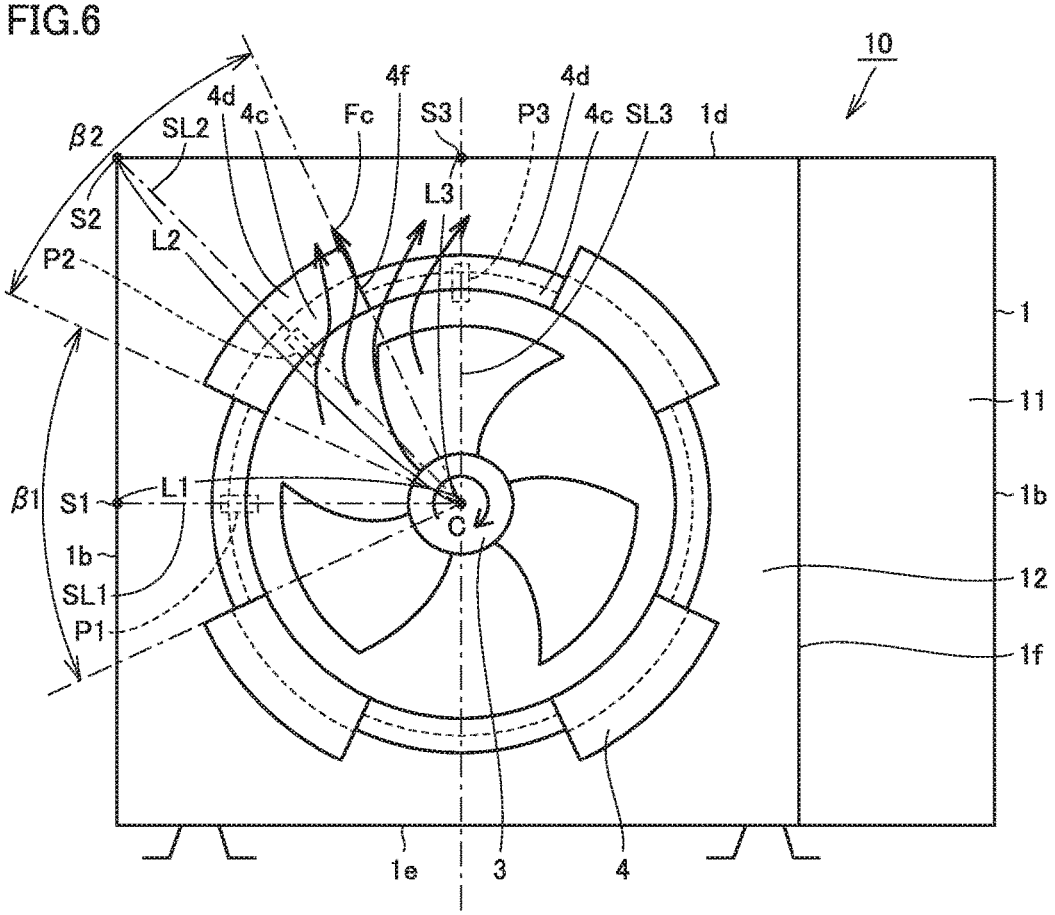
FIG. 6 is a front view schematically showing a configuration of an outdoor unit of an air conditioner according to a second embodiment of the present invention.

As shown in FIG. 6, for example, the radius of curvature of curved portion 4*c* within a range of an angle β1 around center of rotation C is kept constant in the circumferential direction. The radius of curvature of curved portion 4*c* within a range of an angle β2 around center of rotation C is kept constant in the circumferential direction.

The range of angle β2 is a range within which the length between the wall portion of casing 1 and center of rotation C is relatively great as compared to that of the range of angle β1. The radius of curvature of curved portion 4*c* within the range of angle β1 is radius of curvature R1 shown in FIG. 3 (A), for example. The radius of curvature of curved portion 4*c* within the range of angle β2 is radius of curvature R2 shown in FIG. 3 (B), for example. In this manner, the radius of curvature of curved portion 4*c* within the range of angle β2 is set to be relatively greater than the radius of curvature of curved portion 4*c* within the range of angle β1.

Figure 7:
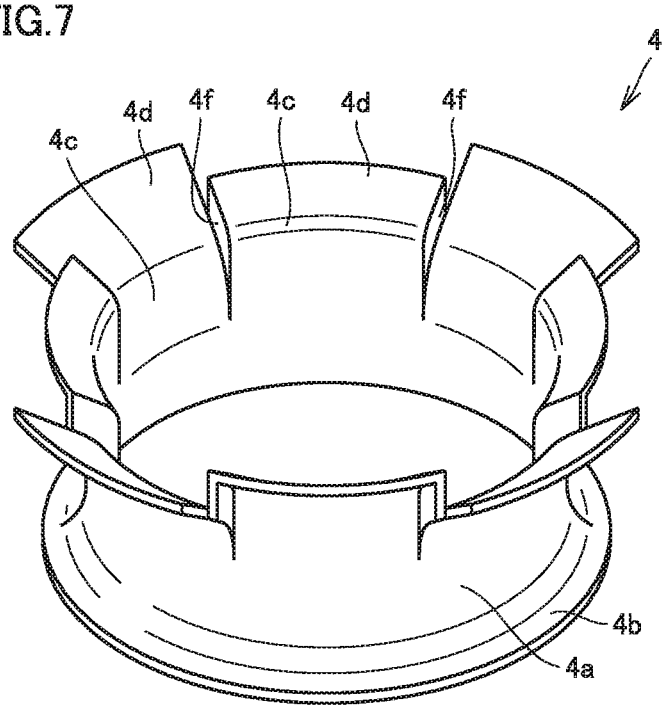
FIG. 7 is a perspective view schematically showing a configuration of a bell mouth for use in the outdoor unit of an air conditioner according to the second embodiment of the present invention.

As shown in FIG. 7, in bell mouth 4 of the present embodiment, a boundary surface 4*f* is provided at the boundary between curved portions 4*c* having different radii of curvatures. This boundary surface 4*f* extends to intersect (for example, orthogonal to) the circumferential direction.

Since the configuration of the present embodiment is otherwise substantially the same as the configuration of the first embodiment described above, the same elements are designated by the same characters and description thereof will not be repeated.

The effects similar to those of the first embodiment described above can be obtained in the present embodiment. Additionally, in the present embodiment, boundary surface 4*f* is provided at the boundary between a part having a greater radius of curvature and a part having a smaller radius of curvature in curved portion 4*c*, as shown in FIG. 7. Accordingly, as shown in FIG. 6, an outlet flow Fc having a whirling component flowing along curved portion 4*c* having a greater radius of curvature collides with boundary surface 4*f*, whereby the whirling component is suppressed to increase an air capacity.

Third Embodiment

A configuration of the present embodiment is different from the configuration of the first embodiment shown in FIGS. 1 to 4 in terms of the configuration of bell mouth 4.

Figure 8:
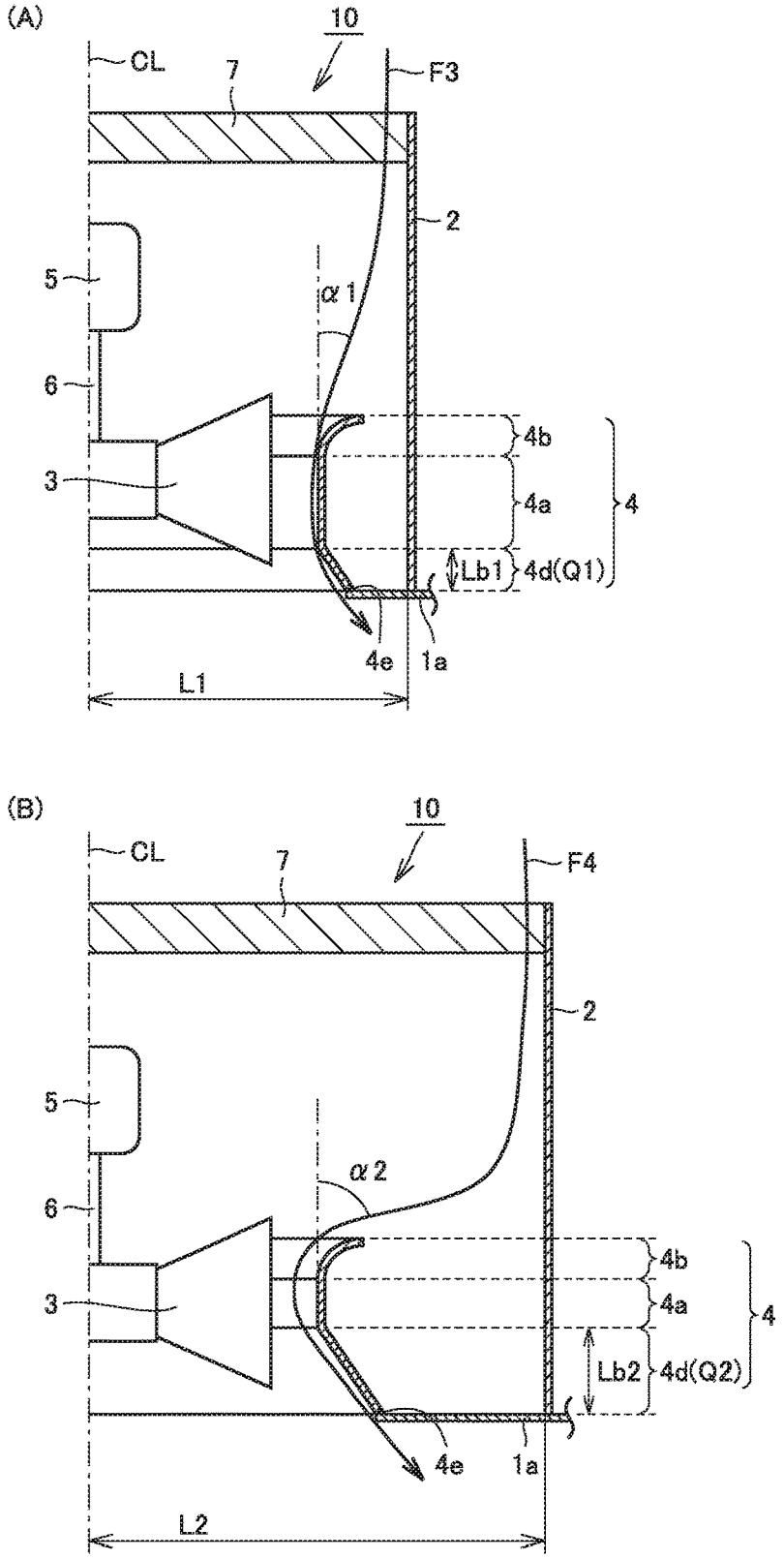
FIG. 8 shows a partial sectional view (A) of a portion in which the length from the center of rotation of an impeller to a wall surface of a casing is L1, and a partial sectional view (B) of a portion in which the aforementioned length is L2, in an outdoor unit of an air conditioner according to a third embodiment of the present invention.

As shown in FIG. 8 (A) and FIG. 8 (B), in bell mouth 4 of the present embodiment, the curved portion is omitted and flared portion 4*d* is directly connected to straight pipe portion 4*a*. Flared portion 4*d* is thus located between straight pipe portion 4*a* and air outlet port 1*aa*. Flared portion 4*d* increases in diameter from impeller 3 toward air outlet port 1*aa*. A joint between straight pipe portion 4*a* and flared portion 4*d* is angulated.

Flared portion 4*d* has a portion (first extending portion) Q1 located in the cross section of relatively smaller length L1 from center of rotation C (axis CL) as shown in FIG. 8 (A), and a portion (second extending portion) Q2 located in the cross section of relatively greater length L2 from center of rotation C (axis CL) as shown in FIG. 8 (B).

It should be noted that the cross section of length L1 in the present embodiment corresponds to the cross section of the portion of length L1 in FIG. 1, for example, and the cross section of length L2 in the present embodiment corresponds to the cross section of the portion of length L2 in FIG. 1, for example.

An axial dimension Lb2 of second extending portion Q2 as shown in FIG. 8 (B) is greater than an axial dimension Lb1 of first extending portion Q1 as shown in FIG. 8 (A). An axial dimension of straight pipe portion 4*a* in the cross section of greater length L2 from center of rotation C as shown in FIG. 8 (B) is smaller than an axial dimension of straight pipe portion 4*a* in the cross section of smaller length L1 from center of rotation C as shown in FIG. 8 (A).

A tilt angle of first extending portion Q1 with respect to straight pipe portion 4*a* shown in FIG. 8 (A) is the same as a tilt angle of second extending portion Q2 with respect to straight pipe portion 4*a* shown in FIG. 8 (B). However, the tilt angle of first extending portion Q1 with respect to straight pipe portion 4*a* shown in FIG. 8 (A) may be different from the tilt angle of second extending portion Q2 with respect to straight pipe portion 4*a* shown in FIG. 8 (B). The axial dimension of flared portion 4*d* may continuously vary in the circumferential direction around center of rotation C.

Since the configuration of the present embodiment is otherwise substantially the same as the configuration of the first embodiment described above, the same elements are designated by the same characters and description thereof will not be repeated.

Next, the function and effect of the present embodiment will be described.

As was described in the first embodiment, in the cross section of the smaller length from center of rotation C as shown in FIG. 8 (A), angle α1 formed by an intake flow F3 and straight pipe portion 4*a* is smaller. In the cross section of the greater length from center of rotation C as shown in FIG. 8 (B), on the other hand, angle α2 formed by an intake flow F4 and straight pipe portion 4*a* is greater. When angle α2 is greater in this manner, inertia in a direction toward the center of impeller 3 acts on intake flow F4. Accordingly, when the axial dimension of flared portion 4*d* is constant, the flow is not sufficiently induced toward the radially outer side, causing separation.

In contrast, in the present embodiment, axial dimension Lb2 of second extending portion Q2 of flared portion 4*d* is set to be greater than axial dimension Lb1 of first extending portion Q1, as shown in FIG. 8 (A) and FIG. 8 (B). Accordingly, even in the cross section of greater angle α2 formed by the intake flow and straight pipe portion 4*a*, dimension Lb2 of second extending portion Q2 is set to be greater, thereby allowing the flow to be induced significantly toward the radially outer side. Accordingly, the flow can be flown along flared portion 4*d*, thereby suppressing the separation and reducing the draft resistance. The suppression of separation can in turn suppress the generation of a turbulent flow and reduce turbulent sound, thereby reducing the noise.

Fourth Embodiment

A configuration of the present embodiment is different from the configuration of the third embodiment shown in FIG. 8 (A) and FIG. 8 (B) in terms of the configuration of bell mouth 4.

In the present embodiment, flared portion 4*d* is configured to maintain at least one of a smaller axial dimension and a greater axial dimension of flared portion 4*d*, in the circumferential direction around center of rotation C.

Figure 9:
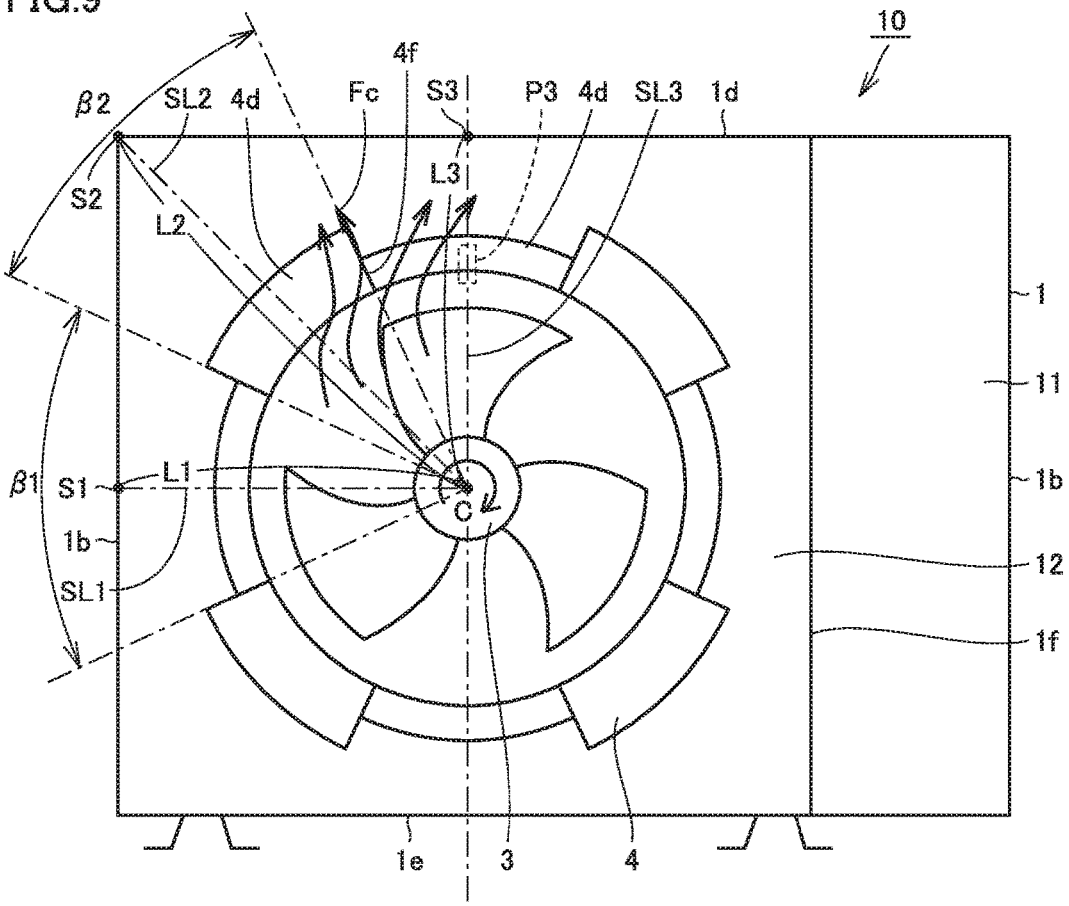
FIG. 9 is a front view schematically showing a configuration of an outdoor unit of an air conditioner according to a fourth embodiment of the present invention.

As shown in FIG. 9, for example, an axial dimension of flared portion 4*d* within the range of angle β1 around center of rotation C is kept constant in the circumferential direction, and an axial dimension of flared portion 4*d* within the range of angle β2 around center of rotation C is kept constant in the circumferential direction.

The range of angle β2 is a range within which the length between the wall portion of casing 1 and center of rotation C is relatively great as compared to that of the range of angle β1. The axial dimension of flared portion 4*d* within the range of angle β2 is set to be greater than the axial dimension of flared portion 4*d* within the range of angle β1.

Figure 10:
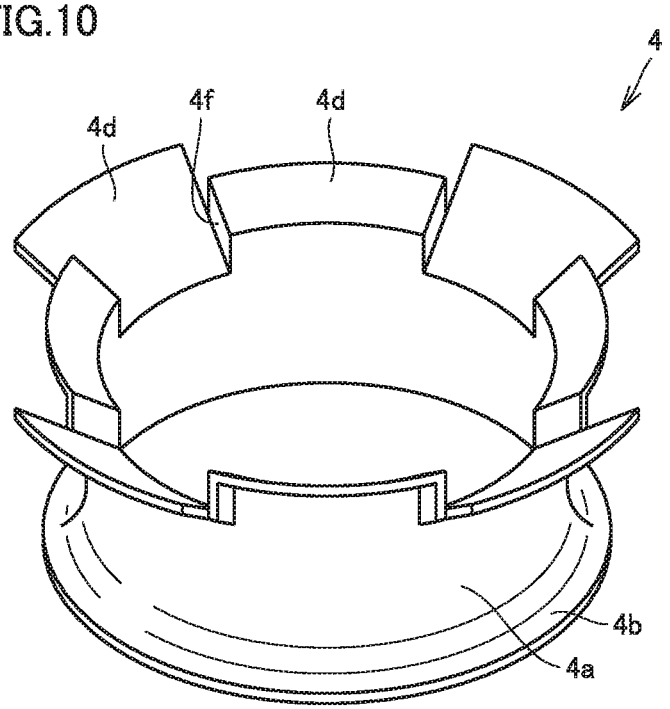
FIG. 10 is a perspective view schematically showing a configuration of a bell mouth for use in the outdoor unit of an air conditioner according to the fourth embodiment of the present invention.

As shown in FIG. 10, bell mouth 4 of the present embodiment has a configuration in which the axial dimensions of flared portion 4*d* are kept constant within the prescribed angular ranges in the circumferential direction, with boundary surface 4*f* provided at the boundary between flared portions 4*d* having different axial dimensions.

Since the configuration of the present embodiment is otherwise substantially the same as the configuration of the third embodiment described above, the same elements are designated by the same characters and description thereof will not be repeated.

The effects similar to those of the third embodiment described above can be obtained in the present embodiment. Additionally, in the present embodiment, boundary surface 4*f* is provided at the boundary between a part having a greater axial dimension and a part having a smaller axial dimension in flared portion 4*d*, as shown in FIG. 10. Accordingly, as shown in FIG. 9, outlet flow Fc having a whirling component flowing along flared portion 4*d* having a greater axial dimension collides with boundary surface 4*f*, whereby the whirling component is suppressed to increase an air capacity.

Fifth Embodiment

A configuration of the present embodiment is different from the configurations of the third and fourth embodiments in terms of the configuration of a connection between straight pipe portion 4*a* and flared portion 4*d*.

Figure 11:
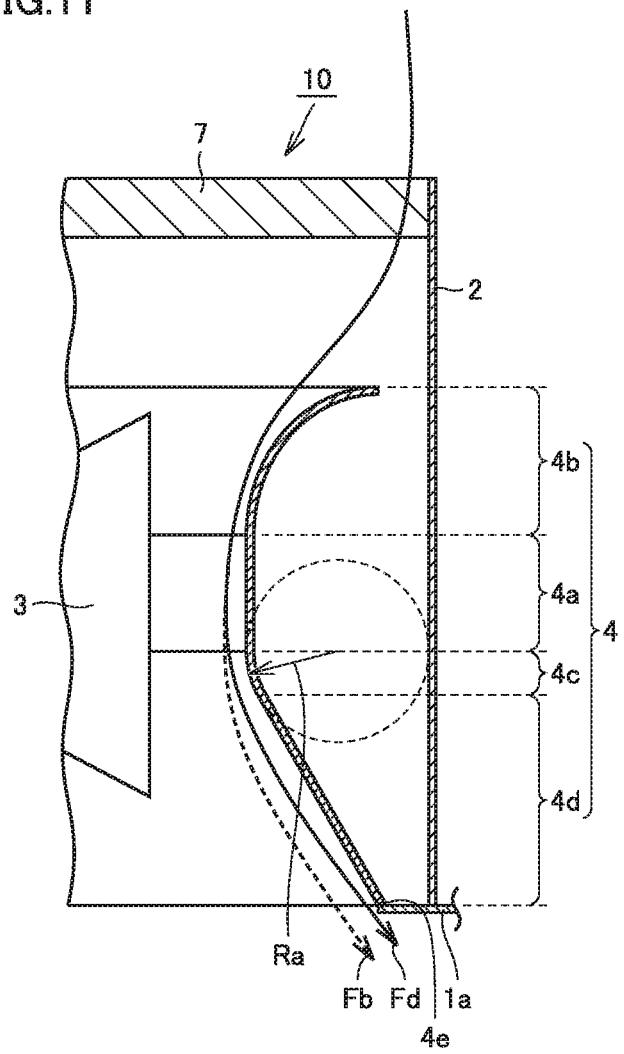
FIG. 11 is a partial sectional view schematically showing a configuration of an outdoor unit of an air conditioner according to a fifth embodiment of the present invention.

As shown in FIG. 11, in the present embodiment, the connection between straight pipe portion 4*a* and flared portion 4*d* has a rounded shape. Specifically, the connection between straight pipe portion 4*a* and flared portion 4*d* is formed of curved portion 4*c* having a circular shape along a prescribed radius of curvature Ra in a cross section along the axis.

Since the configuration of the present embodiment is otherwise substantially the same as the configuration of the third embodiment described above, the same elements are designated by the same characters and description thereof will not be repeated.

The effects similar to those of the third and fourth embodiments described above can be obtained in the present embodiment. If flared portion 4*d* is directly connected to straight pipe portion 4*a*, when the flow moves from straight pipe portion 4*a* to flared portion 4*d*, flow separation may occur at a connection 4*c* as indicated by an arrow Fb in FIG. 11, due to a sudden angular change. In contrast, according to the present embodiment, straight pipe portion 4*a* and flared portion 4*d* are connected by curved portion 4*c* having a circular shape. Thus, the sudden angular change between straight pipe portion 4*a* and flared portion 4*d* can be suppressed, thereby suppressing the separation that occurs at the connection between straight pipe portion 4*a* and flared portion 4*d*, as indicated by an arrow Fd in FIG. 11.

Sixth Embodiment

A configuration of the present embodiment is different from the configurations of the third to fifth embodiments in terms of the configuration of the connection between straight pipe portion 4*a* and flared portion 4*d*.

In the present embodiment, a curved portion having a rounded shape is provided at the connection between straight pipe portion 4*a* and flared portion 4*d*. Additionally, a radius of curvature of the curved portion in the cross section of the portion of the greater length from center of rotation C to the wall surface of casing 1 is set to be greater than a radius of curvature of the curved portion in the cross section of the portion of the smaller length.

Figure 12:
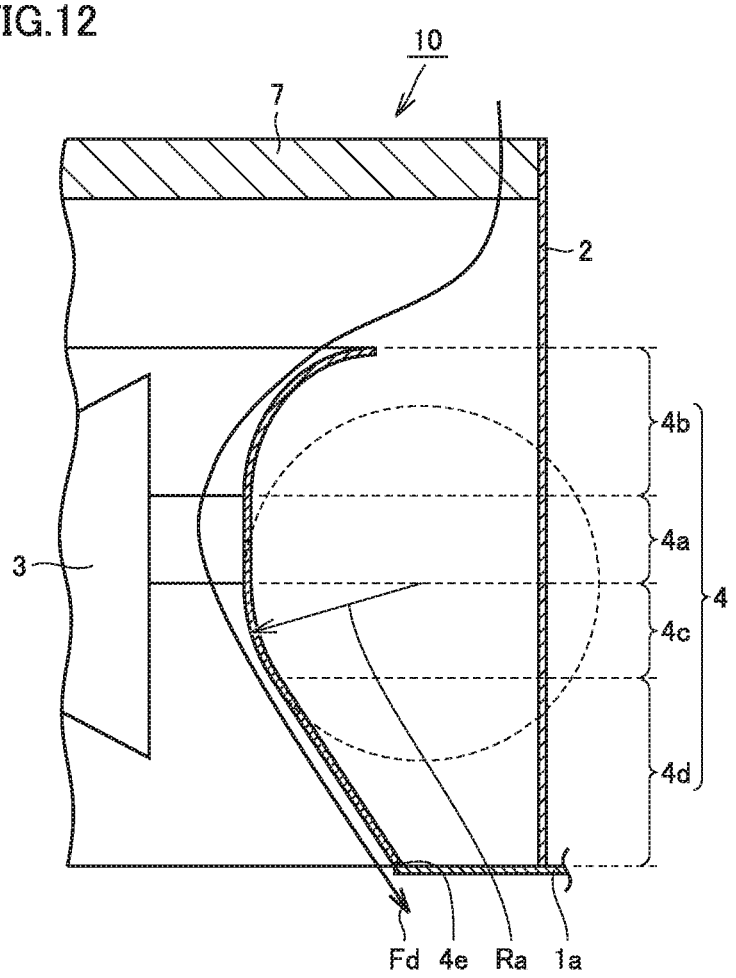
FIG. 12 is a partial sectional view schematically showing a configuration of an outdoor unit of an air conditioner according to a sixth embodiment of the present invention.

Specifically, at the connection between straight pipe portion 4*a* and flared portion 4*d* in the cross section of the portion of the smaller length from center of rotation C to the wall surface of casing 1 as shown in FIG. 8 (A), curved portion 4*c* having a smaller radius of curvature Ra is disposed as shown in FIG. 11. At the connection between straight pipe portion 4*a* and flared portion 4*d* in the cross section of the portion of the greater length from center of rotation C to the wall surface of casing 1 as shown in FIG. 8 (B), curved portion 4*c* having a greater radius of curvature Ra is disposed as shown in FIG. 12.

The aforementioned curved portion in the cross section of the portion of the smaller length from center of rotation C to the wall surface of casing 1 is, for example, a curved surface portion of the curved portion located on straight line SL1 in FIG. 9, for example. The curved portion in the cross section of the portion of the greater length from center of rotation C to the wall surface of casing 1 is, for example, a curved surface portion of the curved portion located on straight line SL2 in FIG. 9, for example.

The effects similar to those of the third to fifth embodiments described above can be obtained in the present embodiment. Additionally, since radius of curvature Ra of curved portion 4*c* varies depending on the length from center of rotation C to the wall surface of casing 1, the flow separation at curved portion 4*c* and flared portion 4*d* can be further suppressed as indicated by an arrow Rd in FIG. 12, and the noise can be further reduced.

Seventh Embodiment

Next, a configuration of a seventh embodiment of the present invention will be described using FIG. 13.

Figure 13:
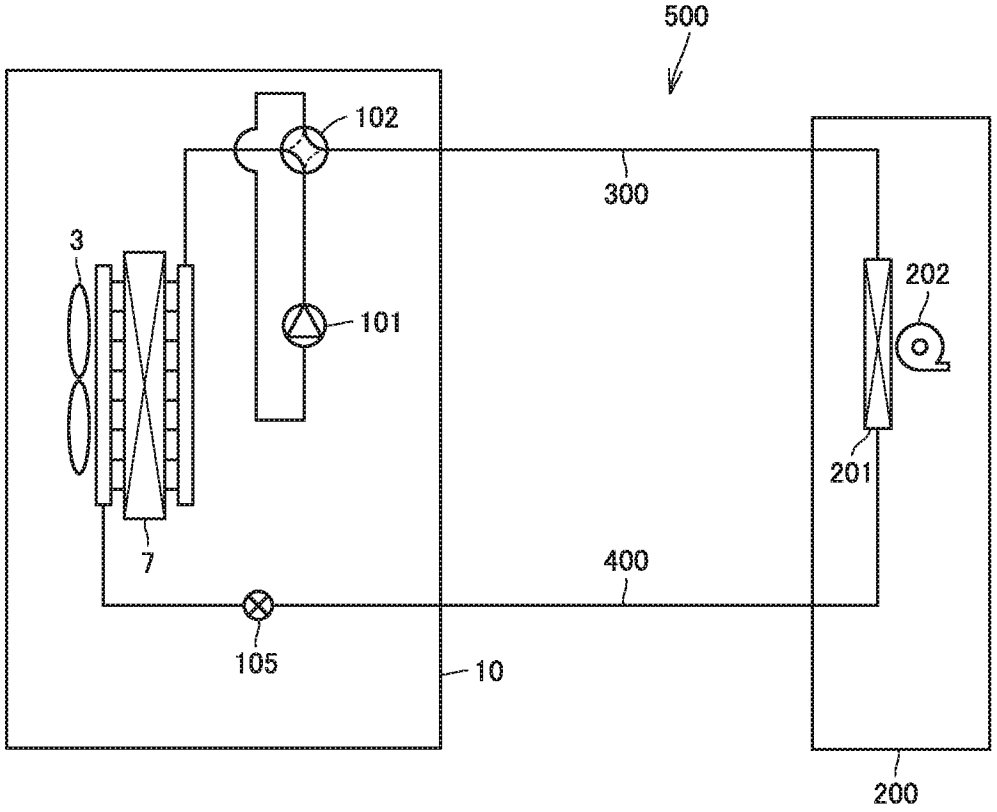
FIG. 13 is a diagram showing a configuration example of a refrigeration cycle device according to a seventh embodiment of the present invention.

FIG. 13 shows, as a refrigeration cycle device, an air conditioning device 500 having the air conditioner (outdoor unit) described in the first embodiment. As shown in FIG. 13, air conditioning device 500 of the present embodiment has outdoor unit 10 described in the first to sixth embodiments, an indoor unit 200, and refrigerant pipes 300 and 400.

Outdoor unit 10 and indoor unit 200 are coupled together by refrigerant pipes 300 and 400. A refrigerant circuit is thus formed, whereby a refrigerant circulates through outdoor unit 10 and indoor unit 200. Refrigerant pipe 300 is a gas pipe through which a gaseous refrigerant (gas refrigerant) flows. Refrigerant pipe 400 is a liquid pipe through which a liquid refrigerant (which may be a gas-liquid two-phase refrigerant) flows.

Outdoor unit 10 has, for example, a compressor 101, a four-way valve 102, outdoor heat exchanger 7, impeller 3, and a restrictor device (expansion valve) 105.

Compressor 101 compresses and discharges an introduced refrigerant. Here, compressor 101 has an inverter device and the like, and the capacity of compressor 101 (an amount of the refrigerant to be fed per unit time) can be minutely changed by arbitrarily changing operation frequency. Four-way valve 102 switches a flow of the refrigerant between cooling operation and heating operation based on an instruction from a control device (not shown).

Outdoor heat exchanger 7 exchanges heat between the refrigerant and air (outdoor air). Outdoor heat exchanger 7 functions as a condenser during the cooling operation, for example. Here, outdoor heat exchanger 7 exchanges heat between the refrigerant compressed by compressor 101 and the air, to condense and liquefy the refrigerant.

Outdoor heat exchanger 7 functions as an evaporator during the heating operation, for example. Here, outdoor heat exchanger 7 exchanges heat between the low-pressure refrigerant reduced in pressure by restrictor device 105 and the air, to evaporate and gasify the refrigerant.

Impeller 3 is provided in the vicinity of outdoor heat exchanger 7 for efficient heat exchange between the refrigerant and the air. A rotation speed of impeller 3 may be minutely changed by arbitrarily changing the operation frequency of driving source (fan motor) 5 by the inverter device.

Restrictor device 105 is provided for adjusting the pressure of the refrigerant and the like by changing the degree of opening of restrictor device 105. The refrigerant condensed by the condenser is reduced in pressure by this restrictor device 105 and expands.

Indoor unit 200 has a load side heat exchanger 201 and a load side blower 202. Load side heat exchanger 201 functions as a condenser during the heating operation, for example. Here, load side heat exchanger 201 exchanges heat between the refrigerant compressed by compressor 101 and the air, to condense and liquefy the refrigerant (or turn the refrigerant into a gas-liquid two-phase refrigerant).

Load side heat exchanger 201 functions as an evaporator during the cooling operation, for example. Here, load side heat exchanger 201 exchanges heat between the low-pressure refrigerant reduced in pressure by restrictor device 105 and the air, to evaporate and gasify the refrigerant.

Load side blower 202 is provided for adjusting an air flow subjected to heat exchange at load side heat exchanger 201. An operation speed of this load side blower 202 is determined by user settings, for example.

Next, the cooling operation and the heating operation in the refrigeration cycle device of the present embodiment will be described.

As shown in FIG. 13, in the cooling operation, four-way valve 102 is switched into a relation of connection indicated by solid lines. The high-temperature, high-pressure gas refrigerant compressed and discharged by compressor 101 passes through four-way valve 102 and flows into outdoor heat exchanger 7. This refrigerant that has flown into outdoor heat exchanger 7 is condensed and liquefied into a liquid refrigerant by heat exchange with the outdoor air fed by impeller 3. This liquid refrigerant flows into restrictor device 105, and is reduced in pressure and brought into a gas-liquid two-phase state by restrictor device 105, before flowing out of outdoor unit 10.

The gas-liquid two-phase refrigerant that has flown out of outdoor unit 10 passes through liquid pipe 400 and flows into load side heat exchanger 201 within indoor unit 200. This refrigerant that has flown into load side heat exchanger 201 is evaporated and gasified into a gas refrigerant by heat exchange with the indoor air fed by load side blower 202. This gas refrigerant flows out of indoor unit 200.

The gas refrigerant that has flown out of indoor unit 200 passes through gas pipe 300 and flows into outdoor unit 10. Subsequently, the gas refrigerant passes through four-way valve 102 and is introduced into compressor 101 again. The refrigerant circulates through refrigeration cycle device 500 in this manner to perform air conditioning (cooling).

In the heating operation, four-way valve 102 is switched into a relation of connection indicated by dotted lines. The high-temperature, high-pressure gas refrigerant compressed and discharged by compressor 101 passes through four-way valve 102 and flows out of outdoor unit 10. The gas refrigerant that has flown out of outdoor unit 10 passes through gas pipe 300 and flows into load side heat exchanger 201 within indoor unit 200. The gas refrigerant that has flown into load side heat exchanger 201 is condensed and liquefied into a liquid refrigerant by heat exchange with the indoor air fed by load side blower 202, and flows out of indoor unit 200.

The liquid refrigerant that has flown out of indoor unit 200 passes through liquid pipe 400 and flows into outdoor unit 10. Subsequently, the liquid refrigerant is reduced in pressure and brought into a gas-liquid two-phase state by restrictor device 105, before flowing into outdoor heat exchanger 7. Then, the refrigerant that has flown into outdoor heat exchanger 7 is evaporated and gasified into a gas refrigerant by heat exchange with the outdoor air fed by impeller 3. This gas refrigerant passes through four-way valve 102 and is introduced into compressor 101 again. The refrigerant circulates through refrigeration cycle device 500 in this manner to perform air conditioning (heating).

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. An outdoor unit of an air conditioner, comprising:

a casing having an air outlet port;

an impeller disposed in the casing and rotatable about a rotating shaft; and a bell mouth surrounding an outer periphery of the impeller, the bell mouth having a straight pipe portion surrounding the outer periphery of the impeller, and a curved portion located between the straight pipe portion and the air outlet port, and increasing in diameter from the straight pipe portion toward the air outlet port, the casing having a wall portion surrounding the outer periphery of the impeller, as seen in an axial direction of the rotating shaft, the wall portion having a first portion, and a second portion located further away from a center of rotation of the rotating shaft than the first portion, as seen in the axial direction, the curved portion having a first curved surface portion located on a line connecting the center of rotation and the first portion, and a second curved surface portion located on a line connecting the center of rotation and the second portion, as seen in the axial direction, and a radius of curvature of the second curved surface portion being greater than a radius of curvature of the first curved surface portion.

2. The outdoor unit of an air conditioner according to claim 1, wherein the curved portion is configured to maintain the radius of curvature of at least one of the first curved surface portion and the second curved surface portion in a circumferential direction around the center of rotation.

3. The outdoor unit of an air conditioner according to claim 1, wherein the casing has a front panel having the air outlet port, and an end portion of the bell mouth is connected to the front panel.

4. A refrigeration cycle device comprising: a compressor to compress and discharge an introduced refrigerant; a condenser to condense the refrigerant compressed by the compressor; a restrictor device to reduce a pressure of the refrigerant condensed by the condenser; and an evaporator to evaporate the refrigerant reduced in pressure by the restrictor device, the outdoor unit of an air conditioner according to claim 1 including one of the condenser and the evaporator.

5. An outdoor unit of an air conditioner, comprising:

a casing having an air outlet port;

an impeller disposed in the casing and rotatable about a rotating shaft; and a bell mouth surrounding an outer periphery of the impeller, the bell mouth having a straight pipe portion surrounding the outer periphery of the impeller, and a flared portion located between the straight pipe portion and the air outlet port, and increasing in diameter from the impeller toward the air outlet port, the casing having a wall portion surrounding the impeller, as seen in an axial direction of the rotating shaft, the wall portion having a first portion, and a second portion located further away from a center of rotation of the rotating shaft than the first portion, as seen in the axial direction, the flared portion having a first extending portion located on a line connecting the center of rotation and the first portion, and a second extending portion located on a line connecting the center of rotation and the second portion, as seen in the axial direction, and the first extending portion having a first dimension along the axial direction, the second extending portion having a second dimension along the axial direction, the second dimension being greater than the first dimension.

6. The outdoor unit of an air conditioner according to claim 5, wherein the flared portion is configured to maintain at least one of the first dimension and the second dimension in a circumferential direction around the center of rotation.

7. The outdoor unit of an air conditioner according to claim 5, wherein the bell mouth further has a curved portion located between the straight pipe portion and the flared portion, and the curved portion has a curved surface, the curved surface connecting a wall surface of the straight pipe portion and a wall surface of the flared portion.

8. The outdoor unit of an air conditioner according to claim 7, wherein the curved portion has a first curved surface portion located on a line connecting the center of rotation and the first portion, and a second curved surface portion located on a line connecting the center of rotation and the second portion, as seen in the axial direction, and a radius of curvature of the second curved surface portion is greater than a radius of curvature of the first curved surface portion.

9. The outdoor unit of an air conditioner according to claim 5, wherein the casing has a front panel having the air outlet port, and an end portion of the bell mouth is connected to the front panel.

10. A refrigeration cycle device comprising: a compressor to compress and discharge an introduced refrigerant; a condenser to condense the refrigerant compressed by the compressor; a restrictor device to reduce a pressure of the refrigerant condensed by the condenser; and an evaporator to evaporate the refrigerant reduced in pressure by the restrictor device, the outdoor unit of an air conditioner according to claim 5 including one of the condenser and the evaporator.

* * * * *